US011228110B2

(12) United States Patent
Sotoma

(10) Patent No.: US 11,228,110 B2
(45) Date of Patent: Jan. 18, 2022

(54) PATCH ANTENNA AND ANTENNA MODULE HAVING THE SAME

(71) Applicant: TDK Corporation, Tokyo (JP)

(72) Inventor: Naoki Sotoma, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/173,218

(22) Filed: Oct. 29, 2018

(65) Prior Publication Data

US 2019/0131711 A1 May 2, 2019

(30) Foreign Application Priority Data

Oct. 27, 2017 (JP) ..... JP2017-207900

(51) Int. Cl.

| | |
|---|---|
| ***H01Q 9/16*** | (2006.01) |
| ***H01Q 5/335*** | (2015.01) |
| ***H01Q 11/14*** | (2006.01) |
| ***H01Q 9/04*** | (2006.01) |
| ***H01Q 21/06*** | (2006.01) |
| ***H01Q 5/378*** | (2015.01) |
| ***H01Q 1/38*** | (2006.01) |
| ***H01Q 1/22*** | (2006.01) |

(52) U.S. Cl.

CPC ..... *H01Q 9/16* (2013.01); *H01Q 1/2283* (2013.01); *H01Q 1/38* (2013.01); *H01Q 5/335* (2015.01); *H01Q 5/378* (2015.01); *H01Q 9/0442* (2013.01); *H01Q 9/0457* (2013.01); *H01Q 11/14* (2013.01); *H01Q 21/065* (2013.01)

(58) Field of Classification Search

CPC ..... H01Q 9/0407; H01Q 9/0414

See application file for complete search history.

(56) References Cited

U.S. PATENT DOCUMENTS

| | | | | |
|---|---|---|---|---|
| 3,978,488 | A * | 8/1976 | Kaloi | H01Q 9/0407 343/829 |
| 4,771,291 | A * | 9/1988 | Lo | H01Q 9/0442 343/700 MS |
| 5,099,249 | A * | 3/1992 | Seavey | H01Q 1/3275 343/700 MS |
| 5,400,041 | A * | 3/1995 | Strickland | H01Q 9/0442 343/700 MS |
| 6,014,105 | A * | 1/2000 | Davis | H01Q 1/36 343/700 MS |
| 6,195,048 | B1 * | 2/2001 | Chiba | H01Q 1/243 343/700 MS |
| 6,774,853 | B2 * | 8/2004 | Wong | H01Q 1/243 343/700 MS |
| 7,038,631 | B2 * | 5/2006 | Jecko | H01Q 9/0421 343/702 |

(Continued)

FOREIGN PATENT DOCUMENTS

| | | |
|---|---|---|
| EP | 3200278 A1 | 8/2017 |
| JP | 2005348345 A | 12/2005 |

(Continued)

*Primary Examiner* — Ab Salam Alkassim, Jr.

(74) *Attorney, Agent, or Firm* — Young Law Firm, P.C.

(57) ABSTRACT

Disclosed herein is a patch antenna that includes a patch conductor and a feed conductor for feeding power to a feed point positioned within a surface of the patch conductor. The patch conductor has a slit around the feed point, the slit being separated from an outer peripheral end of the patch conductor.

8 Claims, 8 Drawing Sheets

(56) References Cited

U.S. PATENT DOCUMENTS

| | | | | |
|---|---|---|---|---|
| 7,161,537 | B2 * | 1/2007 | Rafi | H01Q 9/0442 343/700 MS |
| 7,221,321 | B2 * | 5/2007 | Reuss | H01Q 9/0407 343/700 MS |
| 2005/0243005 | A1 * | 11/2005 | Rafi | H01Q 9/0442 343/767 |
| 2008/0316110 | A1 * | 12/2008 | Kanemura | H01Q 1/2208 343/700 MS |
| 2009/0153404 | A1 * | 6/2009 | Ryou | H01Q 5/378 343/700 MS |
| 2010/0253583 | A1 * | 10/2010 | Furutani | H01Q 9/0407 343/702 |
| 2011/0012788 | A1 * | 1/2011 | Rowell | H01Q 9/0414 343/700 MS |
| 2014/0210674 | A1 * | 7/2014 | Yonei | H01Q 9/0407 343/700 MS |
| 2015/0084208 | A1 * | 3/2015 | Iida | H01L 23/49822 257/774 |
| 2015/0303576 | A1 * | 10/2015 | Latrach | H01Q 1/2208 343/700 MS |
| 2016/0079676 | A1 * | 3/2016 | Chuang | H01Q 13/106 343/770 |
| 2016/0190868 | A1 * | 6/2016 | Shao | H01Q 21/065 307/149 |
| 2016/0308402 | A1 * | 10/2016 | Alavikia | H01Q 21/065 |
| 2018/0337148 | A1 * | 11/2018 | Baek | H01L 25/0657 |

FOREIGN PATENT DOCUMENTS

| | | | |
|---|---|---|---|
| JP | 2013150112 | A | 8/2013 |
| JP | 2017-191961 | A | 10/2017 |

* cited by examiner

PATCH ANTENNA AND ANTENNA MODULE HAVING THE SAME

BACKGROUND OF THE INVENTION

Field of the Invention

The present invention relates to a patch antenna and an antenna module having the same and, more particularly, to a patch antenna capable of easily adjusting characteristics such as impedance and an antenna module having the same.

Description of Related Art

As a method of adjusting the impedance of a patch antenna, there is known a method that shifts the position of a feed point for feeding power to a patch conductor. However, when the position of the feed point is shifted, the shape of a conductor pattern positioned in the lower layer needs to be changed in accordance with the shift amount, resulting in a large design change. Particularly, in an antenna module obtained by laminating an antenna layer including the patch antenna and a circuit layer including a filter circuit, a shift of the position of the feeding point involves a shift of a connection point between a feed conductor and the filter circuit, causing a change in filter characteristics.

As a method of adjusting the impedance of the patch antenna while fixing the feed point position, methods described in JP 2005-348345 A and JP 2013-150112 A are known. In the method disclosed in JP 2005-348345 A, a slit is formed in a ground pattern overlapping a patch conductor so as to adjust characteristics such as impedance. In the method disclosed in JP 2013-150112 A, a slit extending from the outer peripheral end of a patch conductor toward the center thereof is formed for adjustment of characteristics such as impedance.

However, in the method described in JP 2005-348345 A, the adjustment amount of impedance is small. Further, there is a need to change the shape of the ground pattern overlapping the patch conductor, so that when a filter circuit is disposed in the lower layer of the patch antenna, filter characteristics may be changed. In the method described in JP 2013-150112 A, the outer peripheral shape of the patch conductor is changed due to the formation of the slit, causing a bend in a polarization plane.

SUMMARY

It is therefore an object of the present invention to provide a patch antenna capable of easily adjusting characteristics such as impedance without the need for changing the shape of a conductor layer other than the patch conductor and without causing a bend in a polarization plane.

A patch antenna according to the present invention includes a patch conductor and a feed conductor for feeding power to a feed point positioned within the surface of the patch conductor. A slit separated from the outer peripheral end of the patch conductor is formed around the feed point.

According to the present invention, the slit separated from the outer peripheral end of the patch conductor is formed, so that it is possible to adjust characteristics such as impedance by the shape and position of the slit while fixing the position of the feed point. Thus, it is not necessary to change the shape of a conductor layer other than the patch conductor in order to adjust the characteristics such as impedance. In addition, in the present invention, the slit is separated from the outer peripheral end of the patch conductor, thus preventing a bent from occurring in a polarization plane.

In the present invention, at least a part of the slit may be positioned between the center point of the patch conductor and the feed point. Thus, the same effect as that obtained when the feed point is distanced from the center point of the patch conductor can be obtained.

In the present invention, the slit may include a first region that surrounds the feed point by 180°. This allows impedance adjustment effect to be enhanced.

In the present invention, the slit may further include a second region extending in a direction opposite to the center point from one end of the first region and a third region extending in a direction opposite to the center point from the other end of the first region. Thus, it is possible to adjust the impedance by adjusting the lengths of the second and third regions.

In the present invention, at least a part of the slit may be positioned opposite across the feed point from the center point of the patch conductor. This can reduce the impedance as compared to a case where the slit is absent.

The patch antenna according to the present invention may further include a parasitic patch conductor overlapping the patch conductor. This allows wide bandwidth to be achieved.

An antenna module according to the present invention includes an antenna layer in which the above-described patch antenna is formed and a circuit layer laminated on the antenna layer and having a filter circuit connected to a feed conductor.

According to the present invention, even when the impedance of the patch antenna is adjusted by the position and shape of the slit, there is no need to change the design of the filter circuit, and the characteristics of the filter circuit are not changed, thereby facilitating designing.

In the present invention, the filter circuit may include a band-pass filter. This allows only an antenna signal of a specific band to pass.

In the present invention, a plurality of patch conductors may be arranged in an array. This allows a so-called phased array to be achieved.

As described above, according to the present invention, it is possible to easily adjust characteristics such as impedance without the need for changing the shape of a conductor layer other than the patch conductor and without causing a bend in a polarization plane. Thus, the present invention is suitably applied to an antenna module having a configuration in which an antenna layer in which a patch antenna is formed and a circuit layer having a filter circuit are laminated one on the other.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
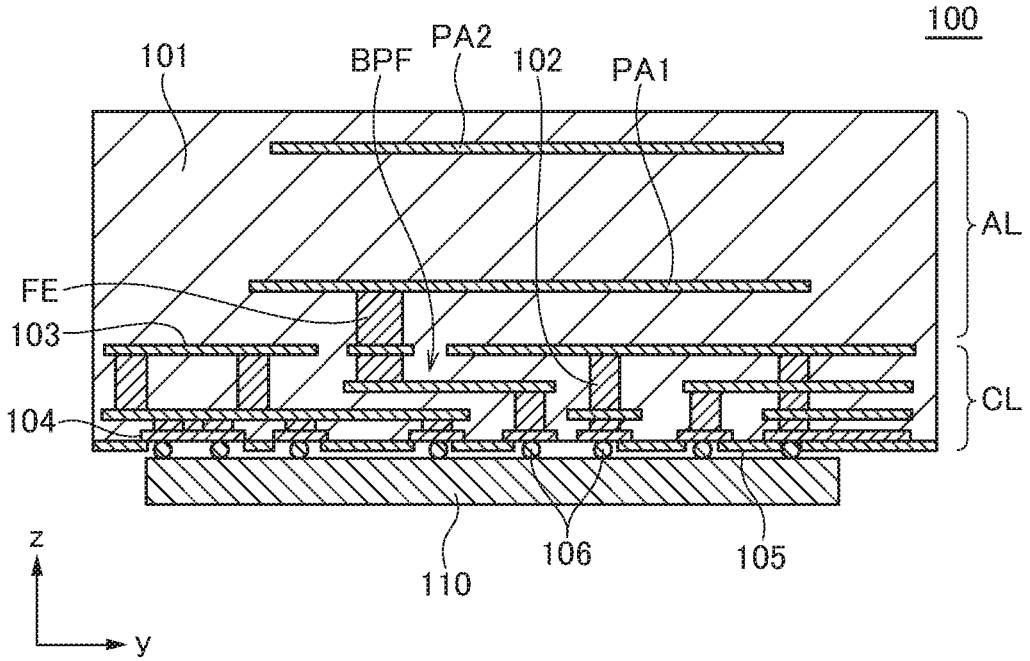
FIG. 1 is a cross-sectional view illustrating the configuration of an antenna module according to a preferred embodiment of the present invention.

FIG. 1 is a cross-sectional view illustrating the configuration of an antenna module 100 according to the preferred embodiment of the present invention.

As illustrated in FIG. 1, the antenna module 100 according to the present embodiment has a configuration in which an antenna layer AL and a circuit layer CL are laminated one on the other, and a semiconductor chip 110 is mounted on the surface of the circuit layer CL. For example, an amplifier circuit, a phase control circuit, a switch circuit, and the like are integrated on the semiconductor chip 110. The antenna layer AL and the circuit layer CL each have a plurality of conductor layers formed inside an insulating layer 101, and conductor layers located at mutually different positions are connected through through-hole conductors 102. The antenna layer AL and the circuit layer CL are separated by a ground pattern 103.

The antenna layer AL has a patch conductor PA1 and a parasitic patch conductor PA2 overlapping each other in the z-direction which is the lamination direction, and a feed conductor FE is connected, from the back surface side, to a predetermined planar position of the patch conductor PA1, whereby a patch antenna is constituted in the antenna layer AL. The feed conductor FE is a pillar-shaped conductor for feeding an antenna signal to the patch conductor PA1 and is connected at the lower end thereof to a band-pass filter BPF included in the circuit layer CL. Although the parasitic patch conductor PA2 may not necessarily be provided in the present invention, it is possible to extend an antenna band by providing the parasitic patch conductor PA2.

The circuit layer CL includes, in addition to the band-pass filter BPF, rewiring for connecting the band-pass filter BPF and a land pattern 104. Out of the bottom surface of the antenna module 100, a region other than a portion where the land pattern 104 is exposed is covered with a solder resist 105. The land pattern 104 is connected to the semiconductor chip 110 through a solder ball 106.

Figure 2:
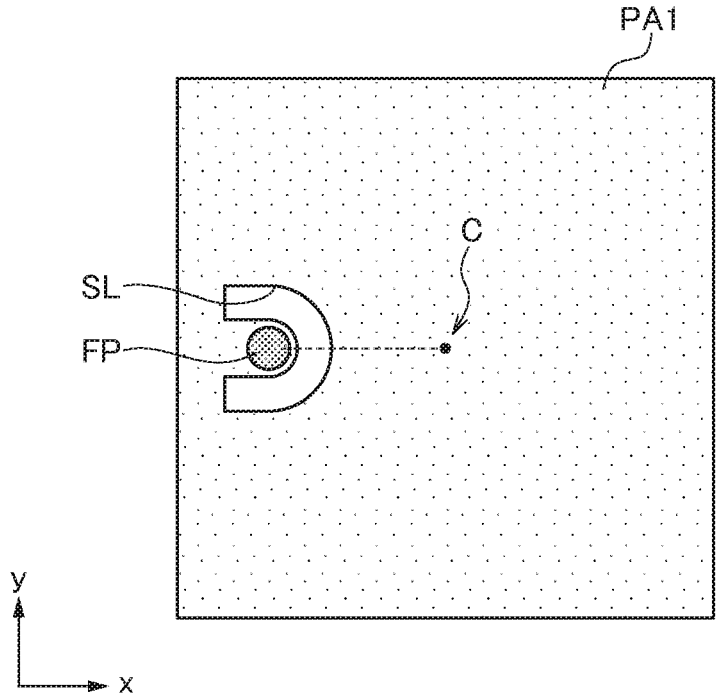
FIG. 2 is a plan view for explaining the shape of the patch conductor.

FIG. 2 is a plan view for explaining the shape of the patch conductor PA1.

Figure 3:
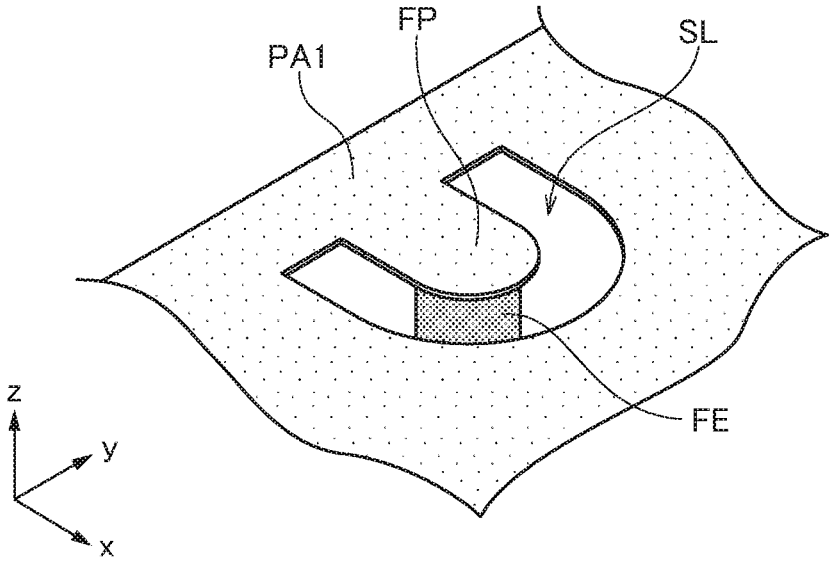
FIG. 3 is a perspective view for explaining the shape of the slit.

As illustrated in FIG. 2, the patch conductor PA1 has a substantially square planar shape, and a feed point FP is disposed at a position offset from a center point C. The feed point FP is a planar position to which the feed conductor FE is connected. Further, in the present embodiment, a slit SL is formed in the patch conductor PA1. The slit SL is a portion where a part of the patch conductor PA1 is removed and has a substantially U-shape in the example of FIG. 2. FIG. 3 illustrates a region where the slit SL is formed as viewed obliquely from above. As illustrated in FIGS. 2 and 3, the slit SL is not connected to the outer peripheral end of the patch conductor PA1 (separated from the outer peripheral end). That is, the edges of the slit SL are closed.

Figure 4:
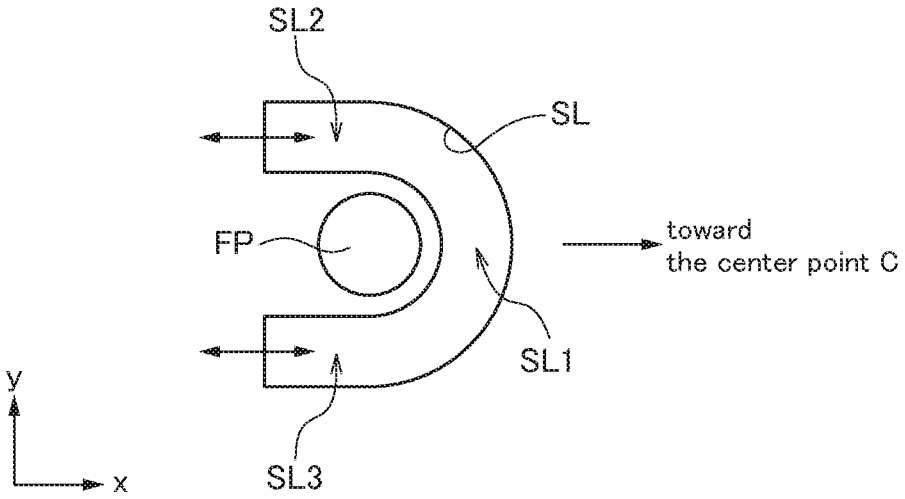
FIG. 4 is a plan view for explaining in more detail the shape of the slit.

FIG. 4 is a plan view for explaining in more detail the shape of the slit SL.

As illustrated in FIG. 4, the slit SL is positioned between the center point C and the feed point FP and has a substantially C-shaped first region SL1 that surrounds the feed point FP by 180°, a second region SL2 extending in the x-direction from one end of the first region SL1 so as to go away from the center point C, and a third region SL3 extending in the x-direction from the other end of the first region SL1 so as to go away from the center point C. With this configuration, current flowing from the feed point FP toward the center point C bypasses the slit SL. Thus, as compared to a case where the slit SL is absent, substantially the same effect as that obtained by extending the distance between the center point C and the feed point FP can be obtained, although the position of the feed point FP is fixed. Thus, characteristics such as impedance are changed as compared to those in a case where the slit SL is absent.

The amount of change in impedance can be adjusted by the lengths of the second and third regions SL2 and SL3 in the x-direction. Specifically, the longer the lengths of the second and third regions SL2 and SL3 in the x-direction is, the more largely the current flowing from the feed point FP toward the center point C detours, so that a result equivalent to that of extending the distance between the center point C and the feed point FP can be obtained.

Figure 5:
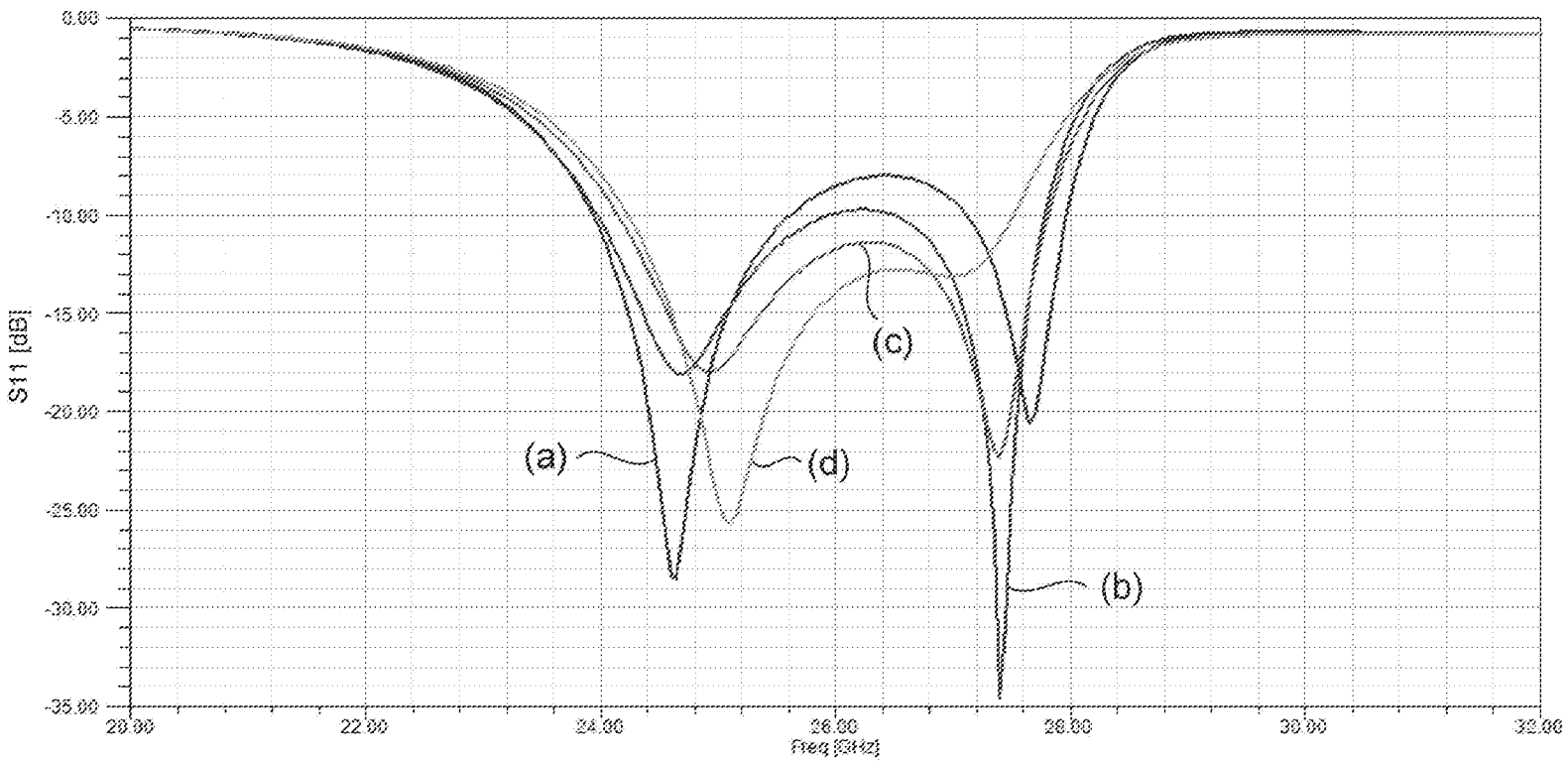
FIG. 5 is a graph illustrating the frequency characteristics of the patch antenna according to the embodiment of the present invention.

FIG. 5 is a graph illustrating the frequency characteristics of the patch antenna according to the present embodiment.

Figure 6A:
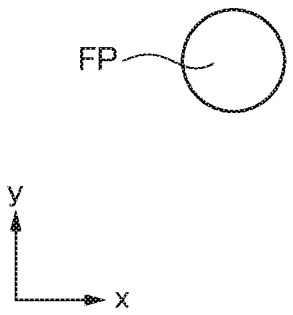
FIGS. 6A to 6D are plan views of the slit corresponding to the characteristics (a) to (d) shown in FIG. 5.
Figure 6B:
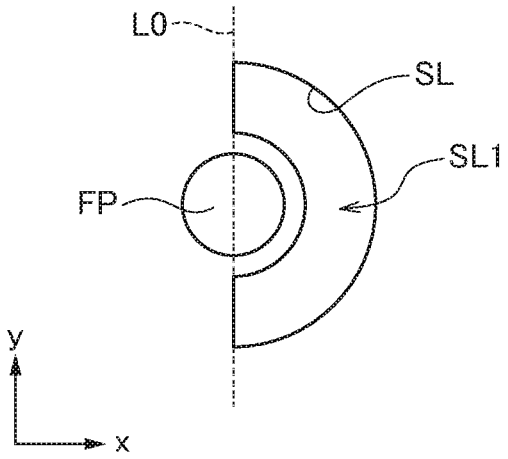
Figure 6C:
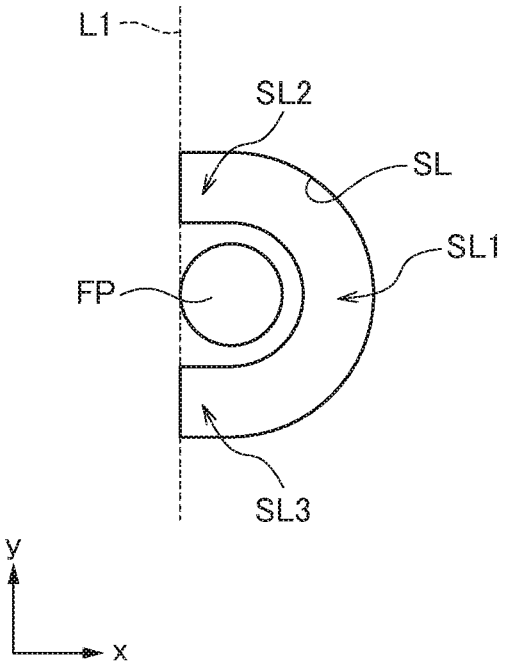
Figure 6D:
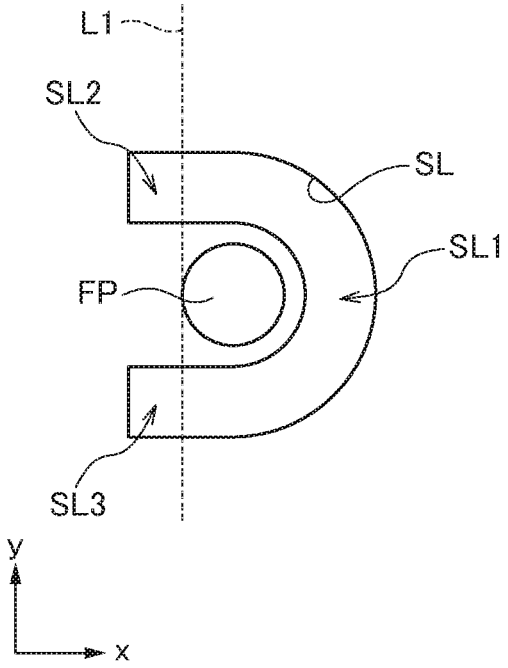

In FIG. 5, the characteristic curves indicated by (a) to (d) correspond respectively to the slits SL of FIGS. 6A to 6D. FIG. 6A is an example in which the slit SL is not formed, FIG. 6B is an example in which the slit SL is constituted of only the first region SL1, and FIGS. 6C and 6D are each an example in which the slit SL is constituted of the first to third regions SL1 to SL3. In the slit SL of FIG. 6B, the positions of the both end portions of the first region SL1 in the x-direction coincide with the center of the feed point FP, and the slit SL surrounds the feed point FP by 180°. In the slit SL of FIG. 6C, the end portions of the respective second and third regions SL2 and SL3 in the x-direction coincide with the end portion (i.e., end portion of the feed conductor FE in a plan view) of the feed point FP in the x-direction. In the slit SL of FIG. 6D, the end portions of the respective second and third regions SL2 and SL3 in the x-direction extend beyond the end portion (i.e., end portion of the feed conductor FE in a plan view) of the feed point FP in the x-direction.

The graph of FIG. 5 reveals that the frequency characteristics of the patch antenna are significantly changed depending on the presence or absence of the slit SL and by the shape of the slit SL. In general, such change in the frequency characteristics is achieved by a shift of the position of the feed point FP, while in the patch antenna according to the present embodiment, it is possible to change the frequency characteristics by changing the shape of the slit SL while fixing the position of the feed point FP. This not only eliminates the need to change the design of the circuit layer CL associated with the adjustment of the frequency characteristics of the patch antenna, but also involves no change in the characteristics of the band-pass filter BPF included in the circuit layer CL.

Figure 7:
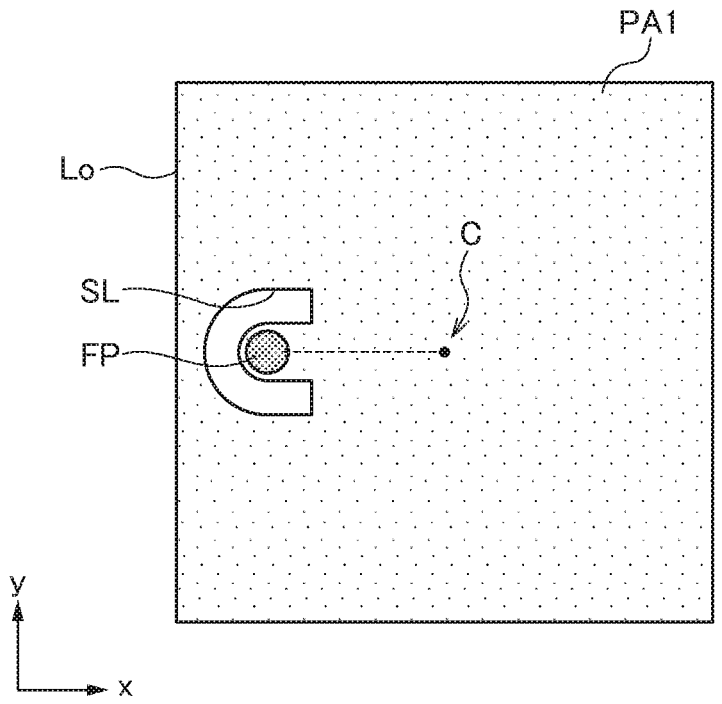
FIG. 7 is a plan view for explaining the shape of the slit according to a modification.

FIG. 7 is a plan view for explaining the shape of the slit SL according to a modification.

Figure 8:
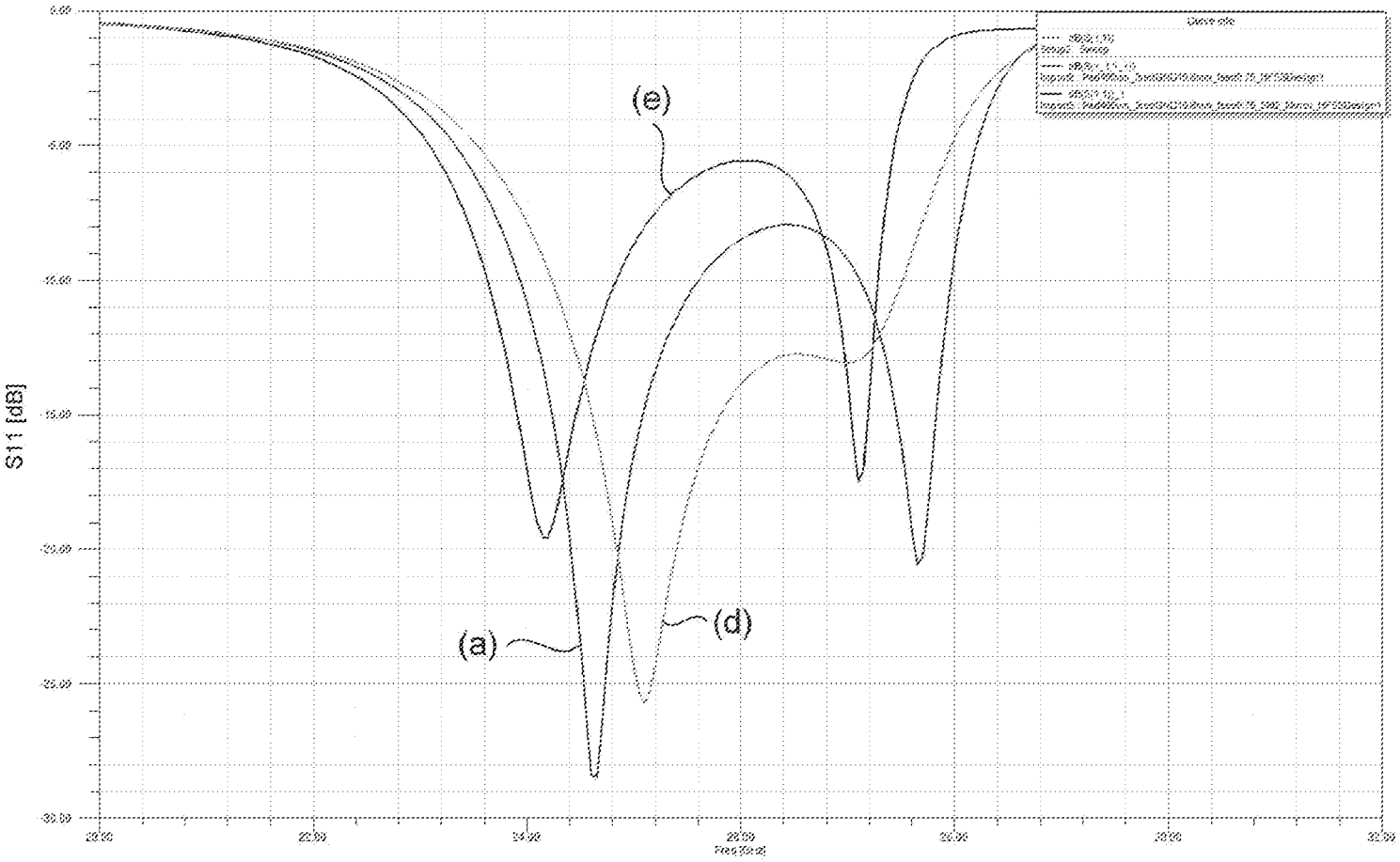
FIG. 8 is a graph illustrating the frequency characteristics of the patch antenna according to the modification.

The example of FIG. 7 differs from the example of FIG. 2 in that the direction of the slit SL is rotated by 180°. Specifically, the slit SL is not positioned between the center point CP and the feed point FP, but instead the slit SL is positioned between the feed point FP and an outer peripheral end Lo adjacent to the feed point FP. That is, the slit SL is positioned opposite across the feed point FP from the center point C. When the slit SL of FIG. 7 is formed in the patch conductor PA1, the impedance is reduced as compared to a case where the slit is absent. As a result, the frequency characteristic curve indicated by (e) of FIG. 8 can be obtained. Like the characteristic curves (a) and (d) illustrated in FIG. 5, the characteristic curves (a) and (d) of FIG. 8 correspond respectively to the slits SL of FIGS. 6A and 6D.

Figure 9A:
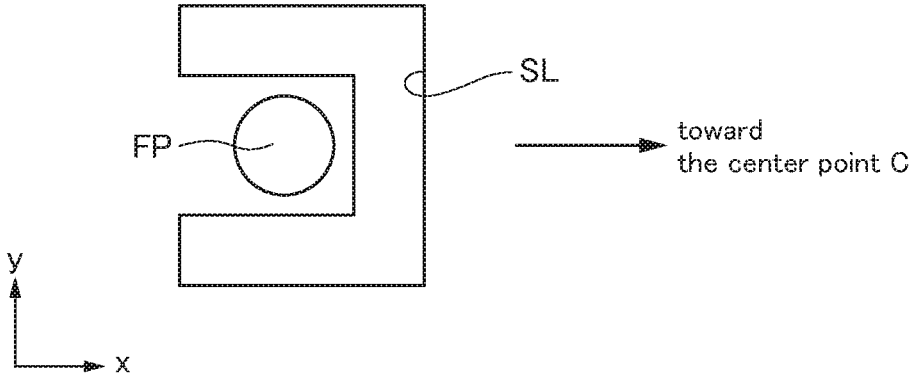
FIGS. 9A to 9C are plan views illustrating variations of the slit.
Figure 9B:
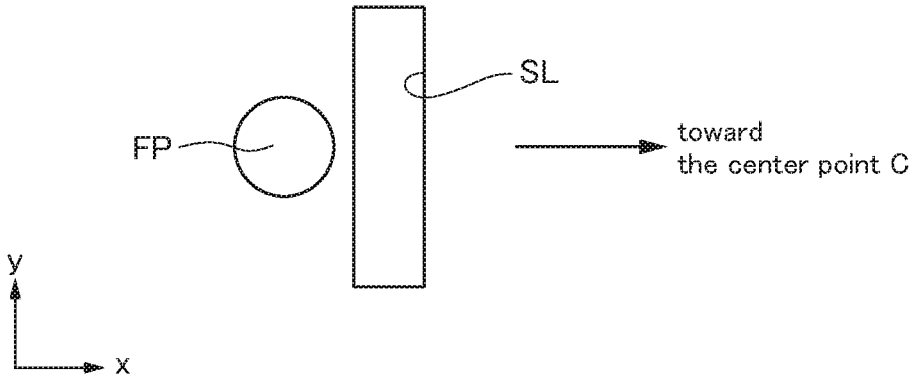
Figure 9C:
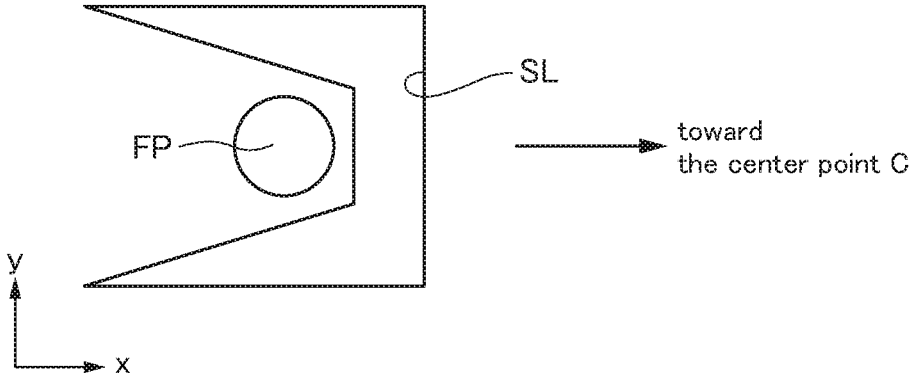

FIGS. 9A to 9C are plan views illustrating variations of the slit SL.

The slit SL of FIG. 9A has a shape in which a portion extending in the x-direction and a portion extending in the y-direction are each formed linearly to thereby linearly surround the feed point FP in three directions. As illustrated in FIG. 9A, the slit SL surrounding the feed point FP may not necessarily have a rounded shape but may have a linear shape. The slit SL of FIG. 9B is constituted of only a portion positioned between the feed point FP and the center point C and extending in the y-direction. As illustrated in FIG. 9B, the slit SL may not necessarily surround the feed point FP. The slit SL of FIG. 9C has a shape in which the width of a portion extending in the x-direction is reduced with the increasing distance from the center point C. This gradually increases the width of the conductor from the feed point FP toward the outer peripheral end of the patch conductor PA1. By forming the slit SL in such a shape, the flow of current on the patch conductor PA1 becomes smoother.

Figure 10:
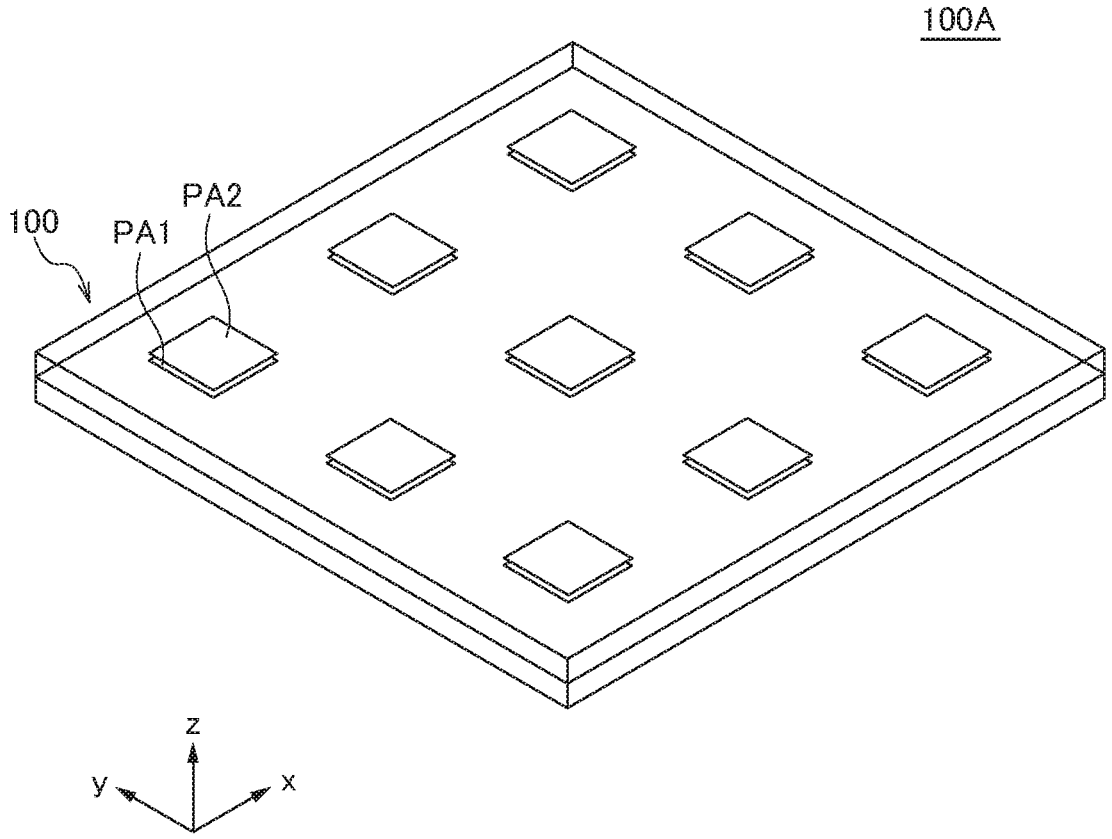
FIG. 10 is a schematic perspective view for explaining the configuration of an antenna module in which a plurality of antenna modules shown in FIG. 1 are laid out in an array.

FIG. 10 is a schematic perspective view for explaining the configuration of an antenna module 100A in which a plurality of antenna modules 100 are laid out in an array. In the example of FIG. 10, nine antenna modules 100 are laid out in an array on the xy plane. When the plurality of antenna modules 100 are thus laid out in an array, a so-called phased array can be achieved. As a result, the direction of beam can be changed as desired.

It is apparent that the present invention is not limited to the above embodiments, but may be modified and changed without departing from the scope and spirit of the invention.

What is claimed is:

1. An antenna module comprising:

an antenna layer; and a circuit layer laminated on the antenna layer, wherein the antenna layer includes a patch antenna comprises:

a patch conductor; and a feed conductor for feeding power to a feed point positioned within a surface of the patch conductor, the feed point at which power is fed to the patch conductor being positioned nearer an outer peripheral end of the patch conductor than a center point of the patch conductor, wherein the patch conductor has a slit around the feed point, the slit being separated from the outer peripheral end of the patch conductor, wherein at least a part of the slit is positioned between the center point of the patch conductor and the feed point, wherein a part of the patch conductor positioned between the feed point and the outer peripheral end is devoid of the slit, such that a current flowing from the feed point to the center point goes around the slit, and wherein the circuit layer includes a filter circuit connected to the feed conductor, wherein the slit includes:

a first region positioned between the feed point and the center point of the patch conductor;

a second region extending toward the outer peripheral end of the patch conductor from one end of the first region; and a third region extending toward the outer peripheral end of the patch conductor from an other end of the first region, and wherein a first distance between each end of the second and third regions closest to the outer peripheral end and the outer peripheral end is smaller than a second distance between the feed point and the center point and is greater than a third distance between each end of the second and third regions that is closest to the outer peripheral end and a part of the feed point that is closest to the outer peripheral end.

2. The antenna module as claimed in claim 1, wherein the filter circuit includes a band-pass filter.

3. The antenna module as claimed in claim 1, wherein a plurality of the patch conductors are arranged in an array.

4. The antenna module as claimed in claim 1, wherein the second and third regions extending parallel to each other.

5. An antenna module comprising:

a circuit layer including a filter circuit and a feed conductor having one end connected to the filter circuit;

an antenna layer laminated on the circuit layer, the antenna layer including a patch conductor connected to other end of the feed conductor; and a ground pattern provided between the circuit layer and the antenna layer, wherein the patch conductor has a slit that includes:

a first region positioned between a feed point at which power is fed to the patch connector connected to the other end of the feed conductor and a center point of the patch conductor;

a second region extending in a direction opposite to the center point from one end of the first region; and a third region extending in a direction opposite to the center point from an other end of the first region, and wherein the second and third regions extend parallel to each other, and wherein the feed point at which power is fed to the patch conductor is positioned nearer an outer peripheral end of the patch conductor than a center point of the patch conductor, and wherein a first distance between each end of the second and third regions closest to the outer peripheral end and the outer peripheral end is smaller than a second distance between the feed point and the center point and is greater than a third distance between each end of the second and third regions closest to the outer peripheral end and a part the feed point that is closest to the outer peripheral end.

6. The antenna module as claimed in claim 5, wherein the first region of the slit has a C-shape.

7. The antenna module as claimed in claim 5, further comprising a semiconductor chip connected to the filter circuit.

8. The antenna module as claimed in claim 5, wherein a part of the patch conductor positioned between the feed point and an outer peripheral end of the patch conductor is devoid of the slit, such that a current flowing from the feed point to the center point goes around the slit.

* * * * *